US007840148B2

(12) United States Patent
Tanaka et al.

(10) Patent No.: US 7,840,148 B2
(45) Date of Patent: Nov. 23, 2010

(54) IMAGE FORMING APPARATUS AND METHOD FOR DETECTING SEPARATED STATE OF TRANSFER MEMBER

(75) Inventors: Masaki Tanaka, Toyohashi (JP); Katsuyuki Hirata, Toyokawa (JP); Mitsuru Obara, Toyohashi (JP); Toshio Tsuboi, Okazaki (JP); Tatsuya Isono, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 958 days.

(21) Appl. No.: 11/704,242

(22) Filed: Feb. 9, 2007

(65) Prior Publication Data

US 2007/0196126 A1 Aug. 23, 2007

(30) Foreign Application Priority Data

Feb. 22, 2006 (JP) ..... 2006-045745

(51) Int. Cl.
*G03G 15/16* (2006.01)

(52) U.S. Cl. ..... 399/66

(58) Field of Classification Search ..... 399/31, 399/66, 121, 308

See application file for complete search history.

(56) References Cited

U.S. PATENT DOCUMENTS 5,181,155 A * 1/1993 Beg et al. ..... 361/94

FOREIGN PATENT DOCUMENTS

| | | |
|---|---|---|
| JP | 6-118814 | 4/1994 |
| JP | 8-297005 | 11/1996 |
| JP | 11-95531 | 4/1999 |
| JP | 2001-83758 | 3/2001 |
| JP | 2004-53637 | 2/2004 |
| JP | 2004-118019 | 4/2004 |
| JP | 2004-245930 | 9/2004 |
| JP | 2004-264455 | 9/2004 |

OTHER PUBLICATIONS

Machine Translation of JP 2004-118019 A.*

Japanese Office Action mailed on Feb. 17, 2009 directed at counterpart application 2006-045745; 8 pages.

Chinese Office Action, mailed Jul. 11, 2008, directed to counterpart Chinese Patent Application No. 200710084914.0; 10 pages.

* cited by examiner

*Primary Examiner*—David M Gray
*Assistant Examiner*—Gregory H Curran
(74) *Attorney, Agent, or Firm*—Morrison & Foerster LLP

(57) ABSTRACT

An image forming apparatus includes a secondary transfer roller that becomes a pressed state to make an intermediate transfer belt perform a transfer process and can move between the pressed state and a separated state, a press and separation driving device for driving the secondary transfer roller to become the pressed state and the separated state, a press and separation detecting device for detecting a pressed or separated state, and a voltage applying portion for applying a voltage between the intermediate transfer belt and the secondary transfer roller. The press and separation detecting device includes a resistor for detecting a current and a determination portion for determining a pressed or separated state in accordance with the detected current.

5 Claims, 12 Drawing Sheets

IMAGE FORMING APPARATUS AND METHOD FOR DETECTING SEPARATED STATE OF TRANSFER MEMBER

This application is based on Japanese Patent Application No. 2006-045745 filed on Feb. 22, 2006, the contents of which are hereby incorporated by reference.

BACKGROUND OF THE INVENTION

1. Field of the Invention

The present invention relates to an image forming apparatus such as a copying machine, a printer, an MFP, a facsimile, or a multifunction device thereof, and a method for detecting a separated state of a transfer member in the image forming apparatus. The present invention can be utilized, for example, for detecting a pressed or separated state of a secondary transfer roller with respect to an intermediate transfer belt.

2. Description of the Prior Art

Conventionally, an image forming apparatus that is called an electrophotographic type copying machine, a printer, a facsimile, a multiple function processor or an MFP (Multi Function Peripherals) forms images by developing an electrostatic latent image formed on a photosensitive drum so as to form a toner image, which is transferred to an intermediate transfer belt as a primary transfer and further transferred to a paper sheet as a secondary transfer, which is fixed. In order to perform the secondary transfer of the toner image from the intermediate transfer belt to the paper sheet, there is provided a secondary transfer roller that becomes a pressed state with respect to the intermediate transfer belt that is an image carrier.

In this image forming apparatus, the secondary transfer roller can move with respect to the intermediate transfer belt between the pressed state and the separated state. Although the secondary transfer roller is in the pressed state in a normal image forming (printing) state, it is normally in the separated state while the image forming process is not performed.

In another conventional structure, a test toner patch is formed on an intermediate transfer belt, and a state of the toner patch is detected by an IDC sensor so that conditions for forming an image are adjusted. In this case too, the secondary transfer roller is set to be in the separated state so that the secondary transfer roller or the like does not become dirty with the toner.

Furthermore, a press and separation driving device is provided for moving the secondary transfer roller, and an optical sensor such as a photointerrupter is used for detecting whether or not the secondary transfer roller is switched securely to the separated state or the pressed state by the press and separation driving device.

However, if the photointerrupter is used for detecting the pressed state and the separated state, the number of components increases, and it causes increase of cost. On the other hand, Japanese unexamined patent publication No. 2004-264455 discloses a device that does not include a special-purpose photointerrupter, but a photointerrupter for use of detecting a paper jam is also used for the above-mentioned purpose.

However, a single photointerrupter is shared for detecting timings of paper arrival and pass and for detecting the pressed or separated state of the secondary transfer roller in the above-mentioned conventional device. Therefore, it is necessary to use a special pre-transfer sensor flag for detecting arrival and pass timings of a paper sheet, so an operation of detecting a paper jam or the like may be subject to some constraints.

SUMMARY OF THE INVENTION

An object of the present invention is to provide an image forming apparatus and a method for detecting a separated state of a transfer member at a low cost without using a photointerrupter.

An apparatus according to one aspect of the present invention is an image forming apparatus having a structure in which a toner image formed in an electrophotographic process is transferred from an image carrier to a member to be transferred. The apparatus includes a transfer member that becomes a pressed state with respect to the image carrier to make the same perform a transfer process and can move between the pressed state and a separated state, a press and separation driving device for driving the transfer member to become the pressed state and the separated state, a press and separation detecting device for detecting the pressed state and the separated state of the transfer member, and a voltage applying portion for applying a voltage between the image carrier and the transfer member. The press and separation detecting device includes a current detecting portion for detecting a current that flows between the image carrier and the transfer member when the voltage is applied by the voltage applying portion, and a determination portion for determining the pressed state and the separated state of the transfer member in accordance with the current detected by the current detecting portion.

Preferably, the determination portion determines the pressed state when a value of the current is larger than a predetermined value and determines the separated state when the value of the current is smaller than the predetermined value.

Alternatively, the determination portion determines the separated state when a gradient of decrease in the value of the current during a predetermined time period is larger than a predetermined value.

According to the present invention, the separated state of the transfer member can be detected at a low cost without using a photointerrupter.

DESCRIPTION OF THE PREFERRED EMBODIMENTS

Hereinafter, the present invention will be explained more in detail with reference to embodiments and drawings.

An image forming apparatus of an electrophotographic type with a secondary transfer usually has a function of detecting current that flows in an opposed portion of the secondary transfer so as to set an output of the secondary transfer. This function is utilized in this embodiment for detecting a pressed or separated state of a secondary transfer roller.

Figure 1:
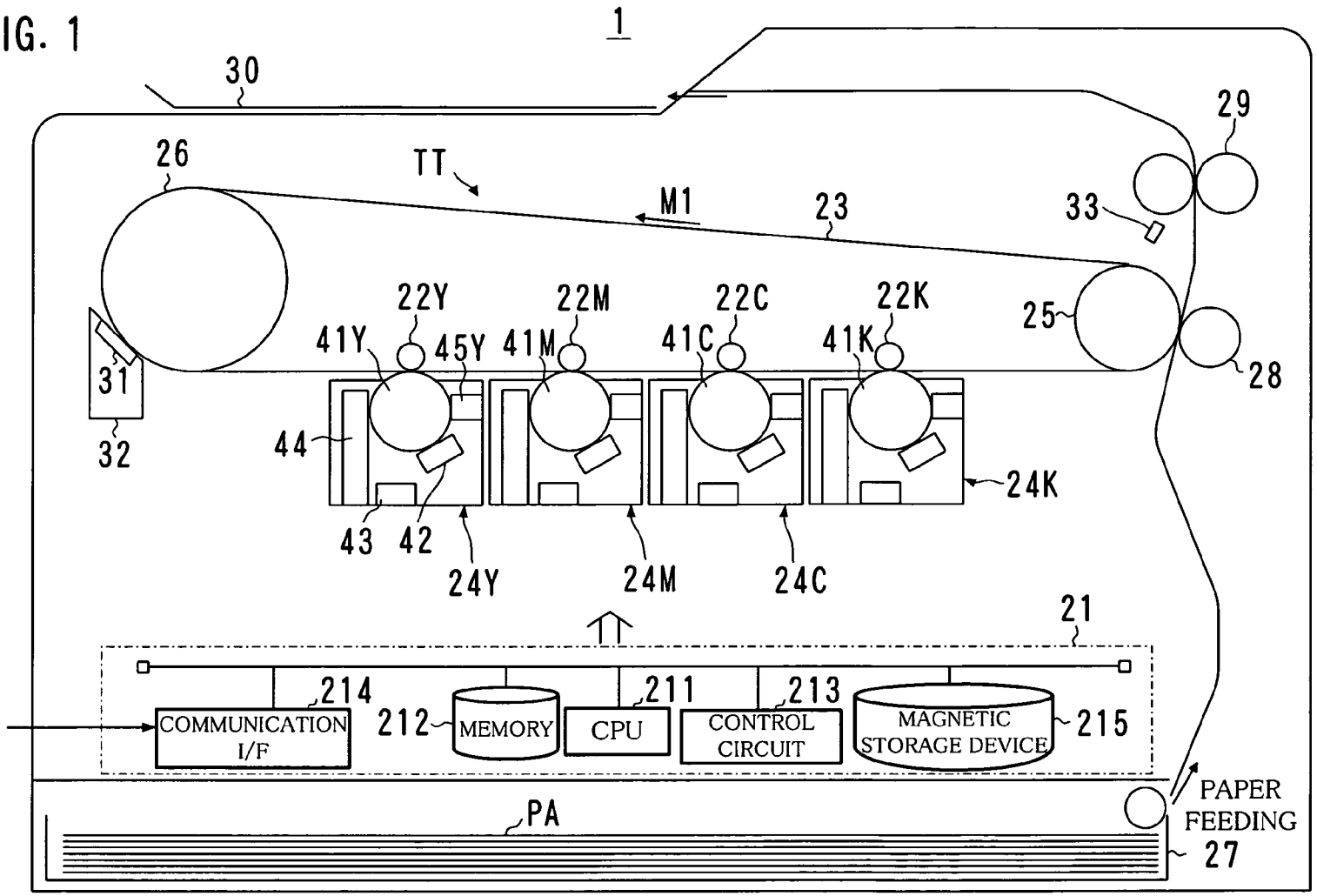
FIG. 1 is a diagram showing a schematic structure of an image forming apparatus according to an embodiment of the present invention.
Figure 2:
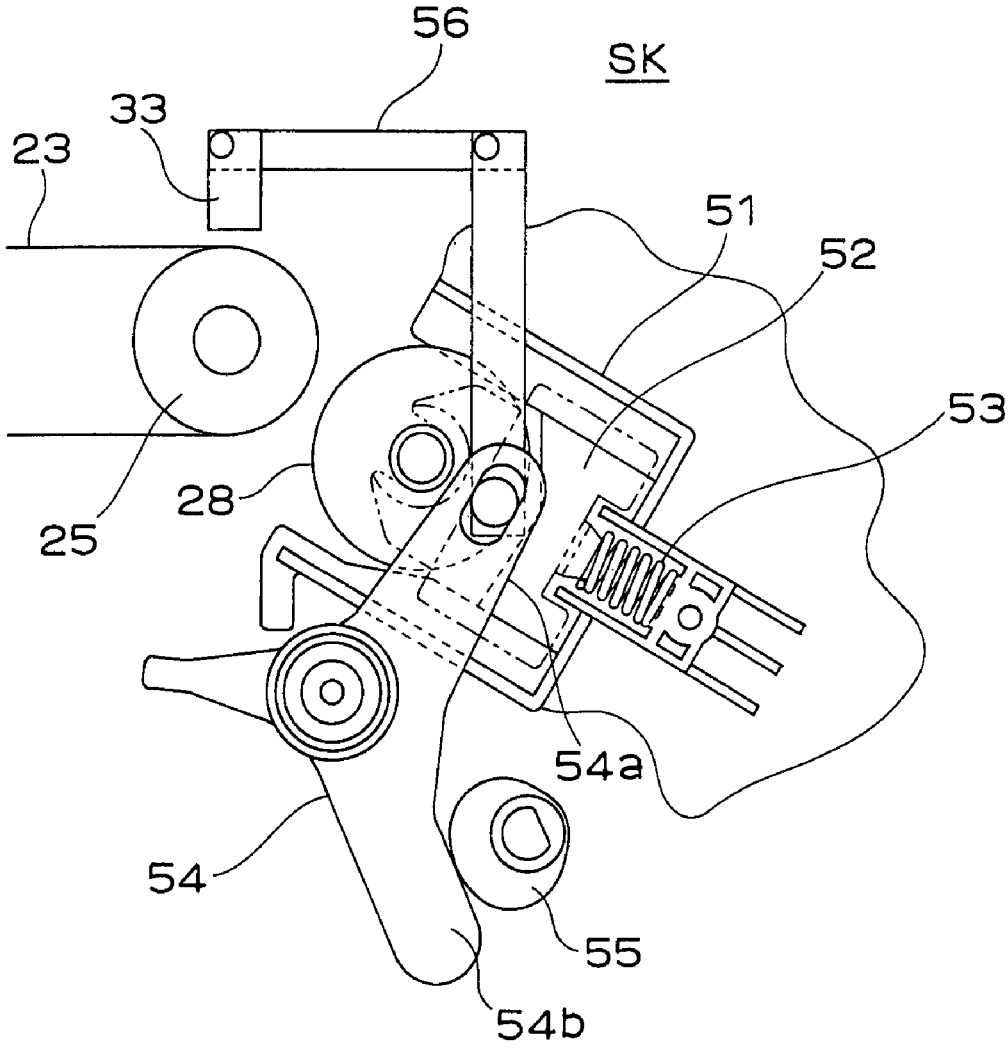
FIG. 2 is a diagram showing an example of a structure of a press and separation driving device that is in a separated state.
Figure 3:
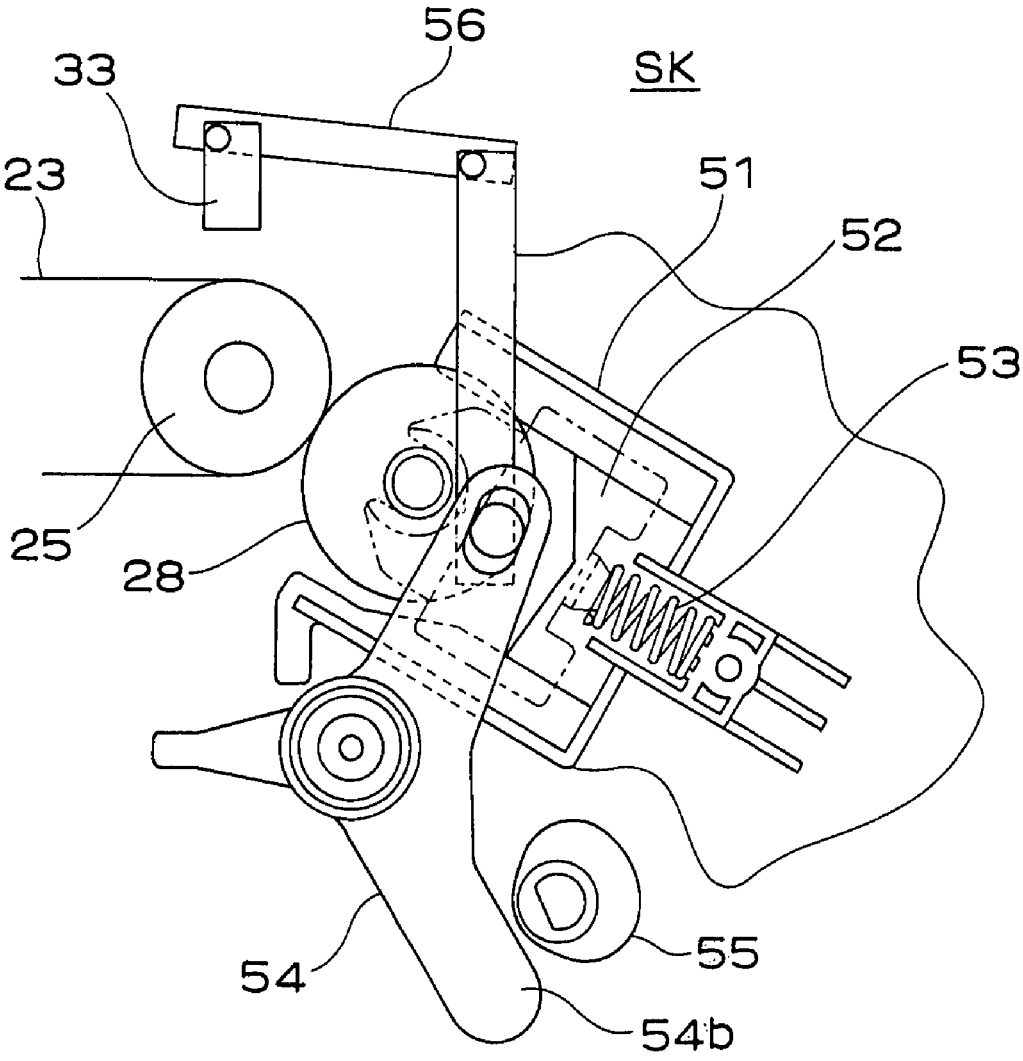
FIG. 3 is a diagram showing an example of a structure of the press and separation driving device that is in a pressed state.

FIG. 1 is a diagram showing a schematic structure of an image forming apparatus 1 according to an embodiment of the present invention, and FIGS. 2 and 3 are diagrams each showing an example of a structure of a press and separation driving device SK. FIG. 2 shows the case where the secondary transfer roller is in the separated state, while FIG. 3 shows the case where the secondary transfer roller is in the pressed state.

As shown in FIG. 1, the image forming apparatus 1 is a digital multifunction device or a printer that utilizes an electrophotographic technique and includes a tandem type print engine.

More specifically, the image forming device 1 includes image forming units 24Y, 24M, 24C and 24K of Y (yellow), M (magenta), C (cyan) and K (black) arranged in a line as a tandem system. Each of the image forming units 24Y, 24M, 24C and 24K includes a photosensitive drum 41, an electro static charger 42 for electrifying a surface of the photosensitive drum 41 uniformly, an exposure portion 43 for exposing the surface of the photosensitive drum 41 to light in accordance with image data of each color so that an electrostatic latent image is formed, a development portion 44 for developing the electrostatic latent image with toner of each color so that a toner image is formed, a transfer roller 22 arranged in a position that is opposed to the photosensitive drum 41 of each color via an intermediate transfer belt 23, and a cleaner 45 for cleaning and collecting toner remaining on the surface of the photosensitive drum 41.

Note that each of the members corresponding to each color of Y, M, C or K may be denoted by a suffix Y, M, C or K in this specification and drawings.

The intermediate transfer belt 23 is tensioned between rollers 25 and 26 along the upper portion of each of the photosensitive drums 41Y, 41M, 41C and 41K, and is driven by the roller 25 to run in the direction indicated by an arrow M1 shown in FIG. 1. Each of the transfer rollers 22Y, 22M, 22C and 22K can be moved between a pressed position where the intermediate transfer belt 23 is pressed to each of the photosensitive drums 41Y, 41M, 41C and 41K and a separated position where the intermediate transfer belt 23 is separated (also referred to as spaced or saved) from each of the photosensitive drums 41Y, 41M, 41C and 41K. When the intermediate transfer belt 23 is pressed to the photosensitive drum 41Y, 41M, 41C or 41K, a toner image of the photosensitive drum 41 is transferred to the intermediate transfer belt 23 as a primary transfer.

The toner image transferred to the intermediate transfer belt 23 as the primary transfer is further transferred by the secondary transfer roller 28 as a secondary transfer to a paper sheet PA, which is a member to be transferred, fed by a paper feed cassette 27. After that, the toner image on the paper sheet PA is fixed in a fixing portion 29 and the paper sheet PA is delivered to a paper delivering tray 30. The secondary transfer roller 28 is switched between the pressed state and the separated state with respect to the intermediate transfer belt 23 by a press and separation driving device (a press and separation mechanism) being various types or having various structures. At the vicinity of the roller 26, there are provided a belt cleaner 31 and a waste toner box 32.

In the vicinity of the roller 25, there is provided an optical IDC sensor 33 for detecting density of a toner image on the intermediate transfer belt 23. More specifically, the IDC sensor 33 projects light to a surface of the intermediate transfer belt 23 and detects returning light after reflected by the same. If the density of the toner image on the intermediate transfer belt 23 is low, i.e., if there is little toner on the intermediate transfer belt 23, much light is reflected by the intermediate transfer belt 23 and quantity of the returning light increases. If the density of the toner image is high, i.e., if there is much toner on the intermediate transfer belt 23, light is interrupted by the toner so that quantity of the reflected light decreases. In this way, the IDC sensor 33 can recognize a state of a naked surface of the intermediate transfer belt 23. The density of the toner image detected by the IDC sensor 33 is used for controlling quantity of light from the exposure portion 43 or controlling conditions for development in the development portion 44, etc as an image adjustment. Actually, the density is detected for each pattern (toner patch) of Y, M, C and K that was generated for the image adjustment.

Although two IDC sensors 33 are provided in this embodiment, it is possible to provide one or three or more IDC sensors 33. In addition, the position where the IDC sensor 33 is attached and a method for attaching the same are not limited to those described above. Other various positions and methods may be adopted.

A control portion 21 includes a CPU 211, a memory 212, a control circuit 213, a communication interface 214 and a magnetic storage device 215. The control portion 21 performs an image process on image data and controls an operation of each portion of the image forming apparatus 1. Hereinafter, in particular, a detection process of a pressed or separated state of the secondary transfer roller 28 with respect to the intermediate transfer belt 23 and its control will be described in detail.

Note that the image forming means or method, and the structure or the configuration of each portion of the image forming apparatus 1 are not limited to the example described above. In addition, the image forming apparatus 1 may be a monochrome or a color copying machine, a printer, a facsimile, a multifunction device thereof or the like.

As shown in FIGS. 2 and 3, the press and separation driving device SK is provided with a holder 51 and a slider 52 held by the holder 51 in a movable manner. The slider 52 retains the rotation axis of the secondary transfer roller 28 and slides with respect to the holder 51. Thus, the slider 52 retains the secondary transfer roller 28 in a movable manner between the separated position (a state shown in FIG. 2) and the pressed position (a state shown in FIG. 3). The holder 51 is provided with a spring 53, and a slider 52 is pressed by the spring 53 toward the pressed position.

In order to return the secondary transfer roller 28 to the separated position, there is a lever 54 that can rotate around an axis having a predetermined position relationship with the holder 51 as well as a cam 55 that is driven to rotate by a motor (not shown). One arm 54*a* of the lever 54 is provided with an elliptic hole that engages a protruding portion of the slider 52. The other arm 54*b* is abutted and pressed by the rotating cam 55, thereby the lever 54 rotates.

In the state shown in FIG. 2, the arm 54*b* is pressed by the cam 55, so that the lever 54 rotates clockwise and moves the slider 52 against the pressing force of the spring 53. Thus, the secondary transfer roller 28 is in the separated position.

In the state shown in FIG. 3, the arm 54*b* is free from the cam 55, so that the secondary transfer roller 28 is pressed by the spring 53 to be in the pressed position.

In addition, the IDC sensor 33 is attached to an end portion of a movable unit 56 that changes its posture in accordance with the slider 52, so it moves in the vertical direction in the drawing when the slider 52 moves. More specifically, when the secondary transfer roller 28 becomes the separated state as shown in FIG. 2, the IDC sensor 33 approaches the intermediate transfer belt 23. When the secondary transfer roller 28 becomes the pressed state as shown in FIG. 3, the IDC sensor 33 is separated from the intermediate transfer belt 23.

Although the IDC sensor 33 is attached in a movable manner by the movable unit 56 in this example, the attachment method of the IDC sensor 33 is not limited to this manner. For example, it is possible to fix the IDC sensor 33 so that it cannot move. Alternatively, the IDC sensor 33 may be disposed below the intermediate transfer belt 23. In addition, the press and separation driving device SK is not limited to the examples shown in FIGS. 2 and 3. It may have various structures or configurations.

Next, two embodiments of a press and separation detecting device ST will be described. The press and separation detecting device ST is used for detecting whether the secondary transfer roller 28 is in the pressed state or in the separated state.

In a first embodiment, in order to detect the separated state of the secondary transfer roller 28, a voltage VH is applied between the roller 25, i.e., the intermediate transfer belt 23 and the secondary transfer roller 28. A small value of current I flows between the intermediate transfer belt 23 and the secondary transfer roller 28 when the voltage VH is applied. The current I is detected. When a value of the current I becomes smaller than a threshold value Th, it is detected to be in the separated state. Alternatively, when a gradient of decrease in the value of the current I becomes larger than the threshold value ThA, it is detected to be in the separated state.

Figure 4:
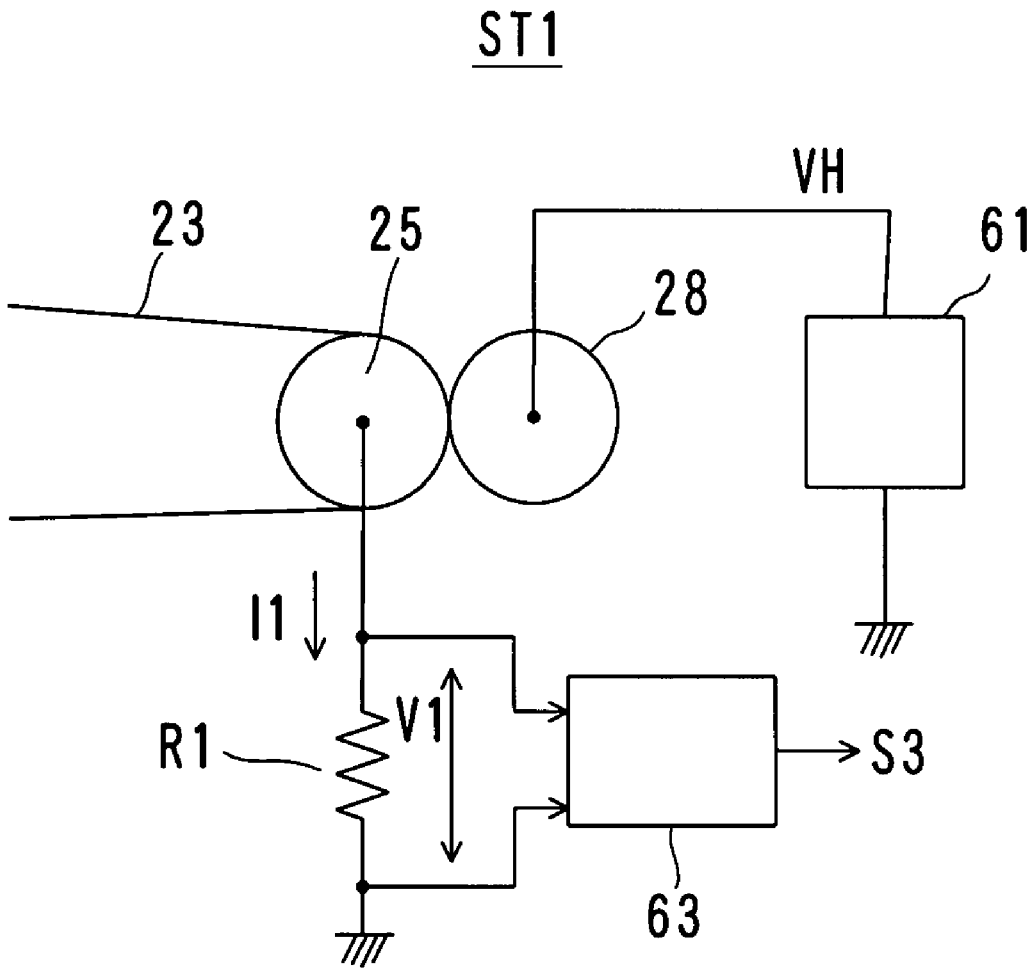
FIG. 4 is a diagram showing a circuit of a press and separation detecting device according to a first embodiment of the present invention.
Figure 5:
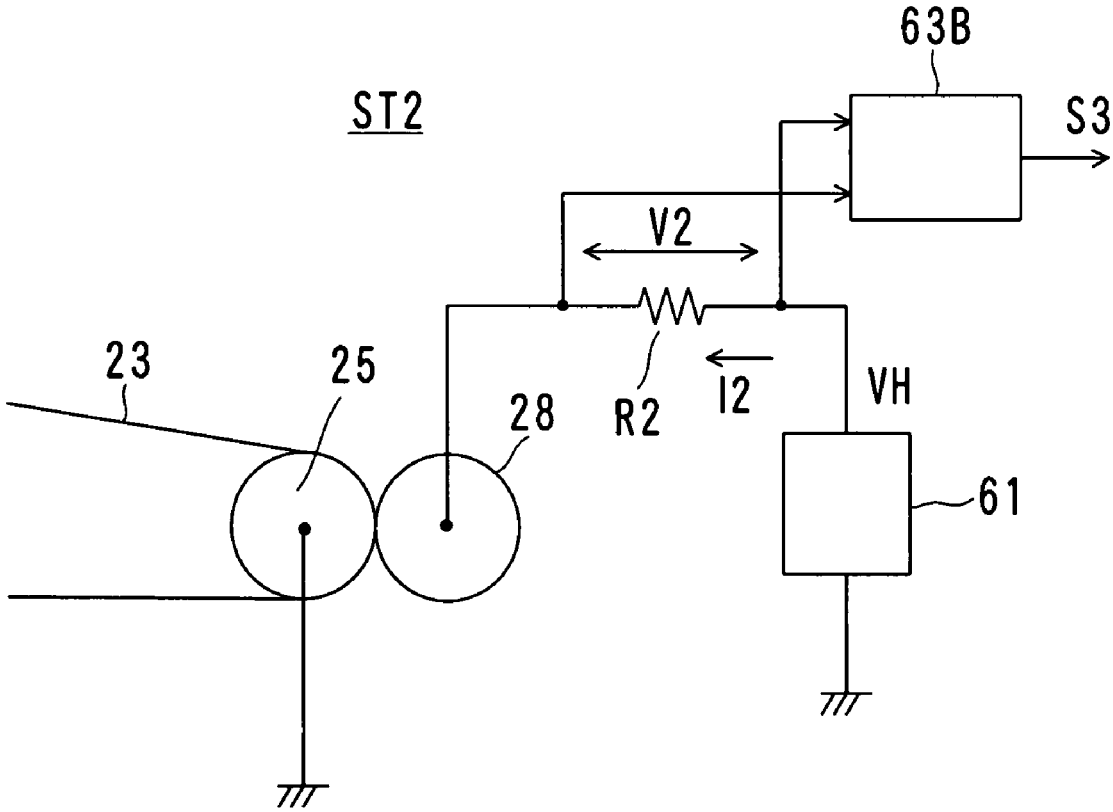
FIG. 5 is a diagram showing a circuit of a press and separation detecting device that is a variation of the first embodiment.
Figure 6:
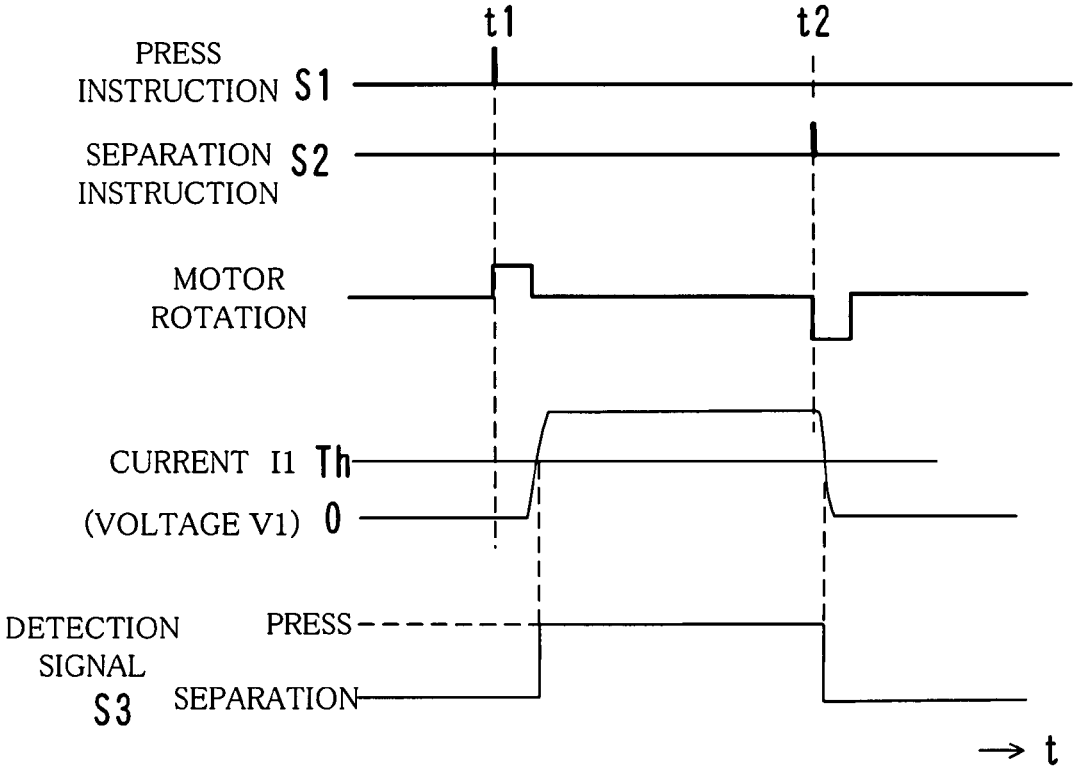
FIG. 6 is a timing chart for explaining a press and separation detecting operation.
Figure 7A:
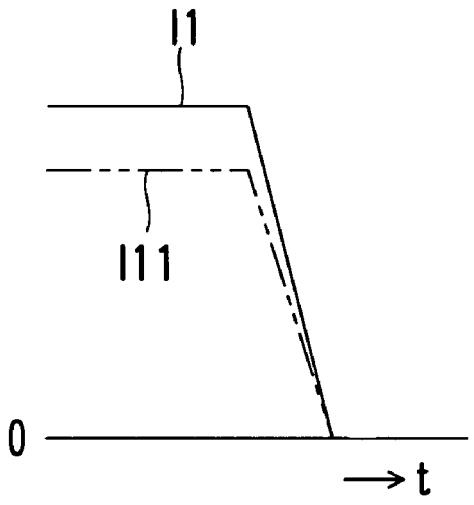
FIGS. 7A and 7B are diagrams showing examples of a change of a current value in transition to the separated state.
Figure 7B:
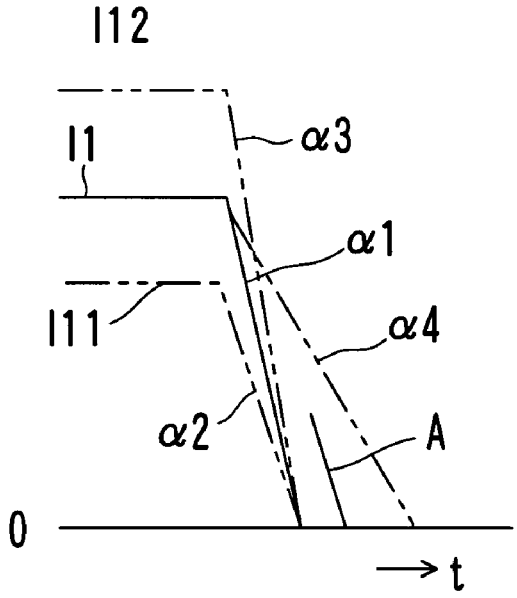

FIG. 4 is a diagram showing a circuit of a press and separation detecting device ST1 according to a first embodiment of the present invention, FIG. 5 is a diagram showing a circuit of a press and separation detecting device ST2 that is a variation of the first embodiment, FIG. 6 is a timing chart for explaining a press and separation detecting operation, and FIGS. 7A and 7B are diagrams showing examples of a change of a value of current I in transition to the separated state.

As shown in FIG. 4, the press and separation detecting device ST1 includes a voltage applying portion 61, a resistor R1 and a determination portion 63.

The voltage applying portion 61 applies a voltage VH between the secondary transfer roller 28 and the intermediate transfer belt 23. More specifically, the voltage applying portion 61 outputs a high voltage VH, and an output terminal thereof is connected to a metal portion of a shaft or the like of the secondary transfer roller 28. The voltage VH from the voltage applying portion 61 is approximately 1-5 KV, for example. The voltage applying portion 61 is provided for transfer operation by the secondary transfer roller 28, and this embodiment utilizes the voltage applying portion 61 for detecting the pressed or separated state.

The roller 25 is connected to the ground, i.e., zero volt potential via the resistor R1. More specifically, an end of the resistor R1 is connected to the metal portion of the shaft or the like of the roller 25, and the other end of the resistor R1 is connected to the ground. The roller 25 should not be connected to the ground directly. When the secondary transfer roller 28 becomes the pressed state with respect to the intermediate transfer belt 23, they are connected to each other electrically though with high resistance. Then, the voltage VH applied to the secondary transfer roller 28 generates the current I that flows in the circuit including the secondary transfer roller 28, the intermediate transfer belt 23, the roller 25 and the resistor R1 that are connected in series.

The intermediate transfer belt 23 and the secondary transfer roller 28 are usually made of a synthetic rubber, a synthetic resin, a foamed plastic or the like, so their electric resistance values are high. However, when a high voltage VH is applied to the secondary transfer roller 28, a few micro or a few tens microamperes of current I flows between them in the pressed state. This micro current I is detected by the resistor R1.

More specifically, the resistor R1 enables detection of current I that flows between the secondary transfer roller 28 and the intermediate transfer belt 23, i.e., in the opposed portion of the secondary transfer roller 28. This current I generates a voltage V1 (=I×R1) across the resistor R1. In other words, the resistor R1 enables the detection of the current I, and the detected voltage V1 is output. In this case, the current I is equivalent to the voltage V1. The resistor R1 has a resistance of a few tens or a few hundreds kilohms, and in this case a few tens millivolts or a few volts of voltage V1 is obtained as the output. This resistor R1 corresponds to a current detecting portion in the present invention.

The determination portion 63 determines whether the secondary transfer roller 28 is in the pressed state or in the separated state in accordance with the voltage V1 across the resistor R1. For example, the determination portion 63 determines that the secondary transfer roller 28 is in the pressed state if the current I is larger than the threshold value Th and determines it is in the separated state if the current I is smaller than the threshold value Th. The threshold value Th may be set to an intermediate value between maximum and minimum values of the current I or a value near the intermediate value.

In addition, when the secondary transfer roller 28 is separated from the intermediate transfer belt 23 by a sufficient distance, the current I does not flow and its value becomes zero, or only a current value like dark current shows up. In other words, since the current I becomes almost zero in the separated state, the threshold value Th may be set to a value near zero.

For example, a secondary transfer roller 28 is made of a foamed plastic and has a diameter of 20 mm, and the voltage VH of 2 KV is applied. Then, the current I of approximately 20 microamperes flows in the pressed state. In this case, if the resistor R1 has resistance of 100 kilohms, for example, the voltage V1 of approximately 2 V shows up across the resistor R1. In the separated state, the current I does not flow and its value becomes almost 0 microampere, and the voltage V1 also becomes almost 0 V.

Note that since the intermediate transfer belt 23 and the secondary transfer roller 28 are made of a synthetic resin or the like, their resistances may change in accordance with their environment, particularly temperature and humidity. In addition, if the image forming apparatus 1 is used for a long period, their resistance values will be changed due to a mechanical or an electrical load on the intermediate transfer belt 23 or the like. Therefore, as shown in FIGS. 7A and 7B, values of current I1, I11 and I12 are changed as shown in a dashed and dotted line in accordance with environment conditions or the like even under the same condition of the voltage VH.

As shown in FIG. 6, if the control portion 21 issues a press instruction S1 at a time point t1 after the separated state for example, a motor (not shown) that is provided to the press and separation driving device SK drives the cam 55 to rotate, so that the secondary transfer roller 28 moves from the separated state to the pressed state. Along with this movement, the current I flows by the voltage VH applied from the voltage applying portion 61, and the current I becomes stable at a certain value or its vicinity. This current I is detected by the resistor R1 as the voltage V1, which is given to the determination portion 63. The determination portion 63 detects the change from the separated state to the pressed state with reference to the threshold value Th that is set to an appropriate value, and the detection signal S3 is output.

When a separation instruction S2 is output at a time point t2, the motor (not shown) drives the cam 55 to rotate in a reverse direction, and the secondary transfer roller 28 moves from the pressed state to the separated state. Along with this movement, the current I decreases rapidly to be almost zero. This change of current I is detected by the resistor R1 as a change of the voltage V1 and is given to the determination portion 63. The determination portion 63 detects the change from the pressed state to the separated state as the current I becomes smaller than the threshold value Th, and the detection signal S3 is output.

It is possible to wait several seconds, e.g., five seconds from the output of the separation instruction S2 until the determination of the change to the separated state.

In accordance with the detection signal S3 that is output from the determination portion 63, a sequence of the image formation, the image adjustment and the like are performed. In addition, if the detection signal S3 is not output at a predetermined timing, an abnormal signal or an error signal is output. Note that the detection signal S3 may be a binary signal indicating the pressed state or the separated state, otherwise it may be a two-bit signal showing each state by each bit. In addition, it can be an electrical or a physical signal or an internal signal like a flag in software for data processing.

As described above, the above-mentioned voltage applying portion 61 may be a high voltage generator that applies a high voltage to the secondary transfer roller 28 for the secondary transfer. In other words, it is possible to share the high voltage generator for the secondary transfer as the voltage applying portion 61. In the state where the high voltage generator applies the voltage VH to the secondary transfer roller 28, if the current I flows into the intermediate transfer belt 23 that is the opposed portion of the secondary transfer roller 28, it is detected to be in the pressed state. The current I in such a state is detected and is used for detecting the pressed or separated state. Therefore, using the conventional high voltage generator as the voltage applying portion 61 and adding only the resistor R1 and the determination portion 63 can make up the press and separation detecting device ST1.

Furthermore, in accordance with the voltage VH that is applied to the secondary transfer roller 28 and the current I flowing there, a resistance of the secondary transfer roller 28 at that time is detected, and a voltage VH to be applied to the secondary transfer roller 28 is determined. This function and its structure are known conventionally.

Although the determination portion 63 determines the pressed or separated state in accordance with a level of the current I in the example described above, it is possible to determine the state in accordance with a gradient of the current I. For example, if a gradient $\alpha$ of decrease in the current I is larger than the threshold value ThA, it is determined to be in the separated state. More specifically, since the current I decreases rapidly when the pressed state changes to the separated state, a gradient $\alpha$ thereof becomes large in the negative direction. Therefore, if the absolute value of the gradient $\alpha$ is larger than the threshold value ThA, it can be determined to have become the separated state.

More specifically, as shown in FIG. 7B for example, if the gradient of the current I is $\alpha 1$, $\alpha 2$ or $\alpha 3$ that is larger than the threshold value ThA, it can be determined to have become the separated state and the detection signal S3 is output. However, if the gradient of the current I is $\alpha 4$ that is smaller than the threshold value ThA, it is not determined to have become the separated state. In this case, the separation instruction S2 may be output again to repeat the separation operation, or an error signal may be output, for example.

In addition, in the example shown in FIG. 4, the resistor R1 for detecting the current I is connected between the roller 25 and the ground. However, the connection position of the resistor R1 is not limited thereto. Another example is as follows.

As shown in FIG. 5, a resistor R2 is connected between the output terminal of the voltage applying portion 61 and the secondary transfer roller 28. A current I2 that flows through the resistor R2 generates a voltage V2 across the resistor R2, and the voltage V2 is given to a determination portion 63B. The determination portion 63B determines the pressed or separated state of the secondary transfer roller 28 in accordance with the voltage V2, i.e., the current I2 and outputs the detection signal S3.

In the example shown in FIG. 5, the voltage V2 generated across the resistor R2 has the positive polarity at the end near to the voltage applying portion 61. In addition, since a high voltage is applied to both ends of the resistor R2, an appropriate isolator or coupling device may be used in the determination portion 63B.

There may be the case where even after the press instruction S1 or the separation instruction S2 was issued, the detection signal S3 indicating the pressed state or the separated state is not output because of a trouble or the like in the press and separation driving device SK. An example of a process and an operation to be performed in this case will be described next.

For example, it is supposed that even though a predetermined time period has passed after the separation instruction S2 was issued, i.e., after the secondary transfer roller 28 is driven to become the separated state, the detection signal S3 indicating the separated state is not output. In this case, the separation instruction S2 is issued again, so that the press and separation driving device SK drives the secondary transfer roller 28 to become the separated state.

In addition, if the detection signal S3 indicating the separated state is not output even though a predetermined time period has passed after the separation instruction S2 was issued or even though the separation instruction S2 is reissued a predetermined number of times, e.g., three times, a signal indicating an abnormal state is output.

In addition, the press instruction S1 or the abnormal signal may be output like the above-described case also in the case where a predetermined time period has passed after the press instruction S1 was output or after the press instruction S1 is reissued a predetermined number of times.

Next, an example is described of controlling a NIP width in accordance with the current I detected by the resistor R1 or R2.

After the press and separation driving device SK drives the secondary transfer roller 28 to become the separated state, a control of the NIP width of the intermediate transfer belt 23 and the secondary transfer roller 28 can be performed in accordance with the current I detected by the resistor R1 or R2.

Figure 8:
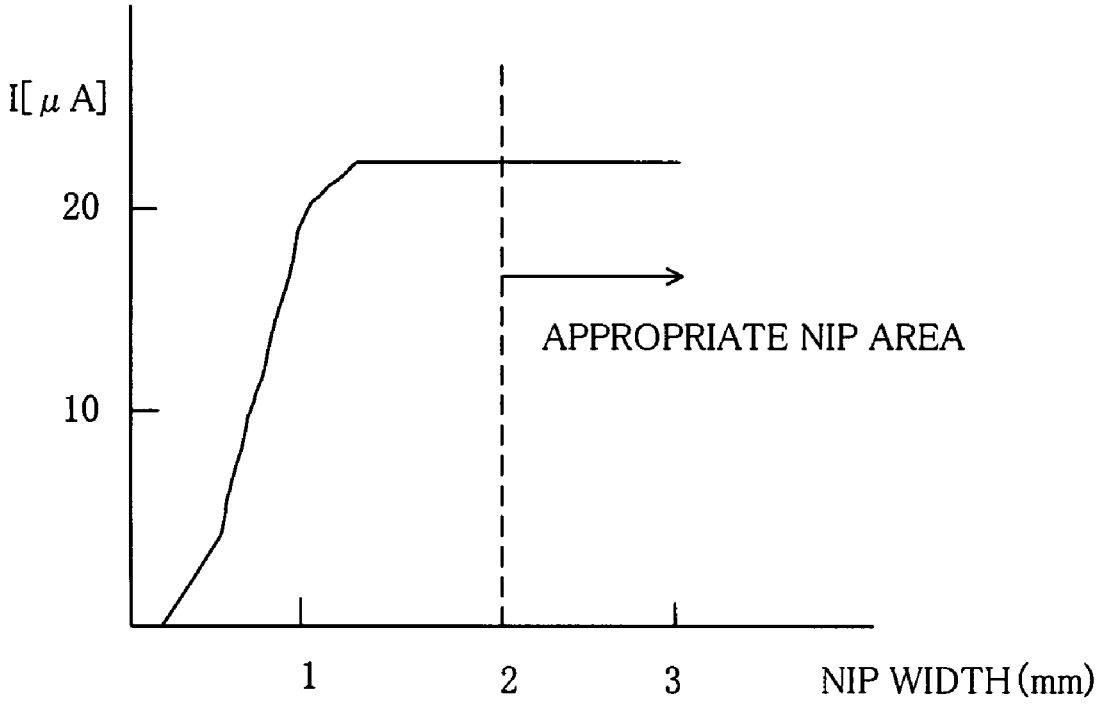
FIG. 8 is a diagram showing a relationship between current that flows in an intermediate transfer belt and a NIP width.

FIG. 8 is a diagram showing a relationship between current I that flows between the intermediate transfer belt 23 and the secondary transfer roller 28 and a NIP width.

Here, the NIP width means a width of contacting portion between the secondary transfer roller 28 and the roller 25 or the intermediate transfer belt 23 that is opposed to the secondary transfer roller 28. In a pressing or separating operation of the secondary transfer roller 28, after a separating operation is performed responding to the separation instruction S2, the NIP width of the secondary transfer roller 28 and the intermediate transfer belt 23 that is a carrier of the toner image is controlled in accordance with the absolute value of the current I that flows through the resistor R1.

As shown in FIG. 8, the NIP width changes from 0 mm to 1.2 mm while the current I changes from 0 to 22 microamperes. Therefore, the NIP width can be controlled by detecting the current I. In this way, the NIP width can be controlled in accordance with a property such as a thickness of the paper sheet PA.

Next, the image adjustment by the IDC sensor 33 will be described briefly.

The image adjustment is performed by detecting toner quantity on the intermediate transfer belt 23 so that appropriate toner quantity is obtained. More specifically, a development bias voltage that is applied to the development portion 44 shown in FIG. 1 is switched so that a plurality of toner patches is formed on the intermediate transfer belt 23. Then, densities, i.e., toner quantity of the toner patches are detected by the IDC sensor 33.

Figure 9:
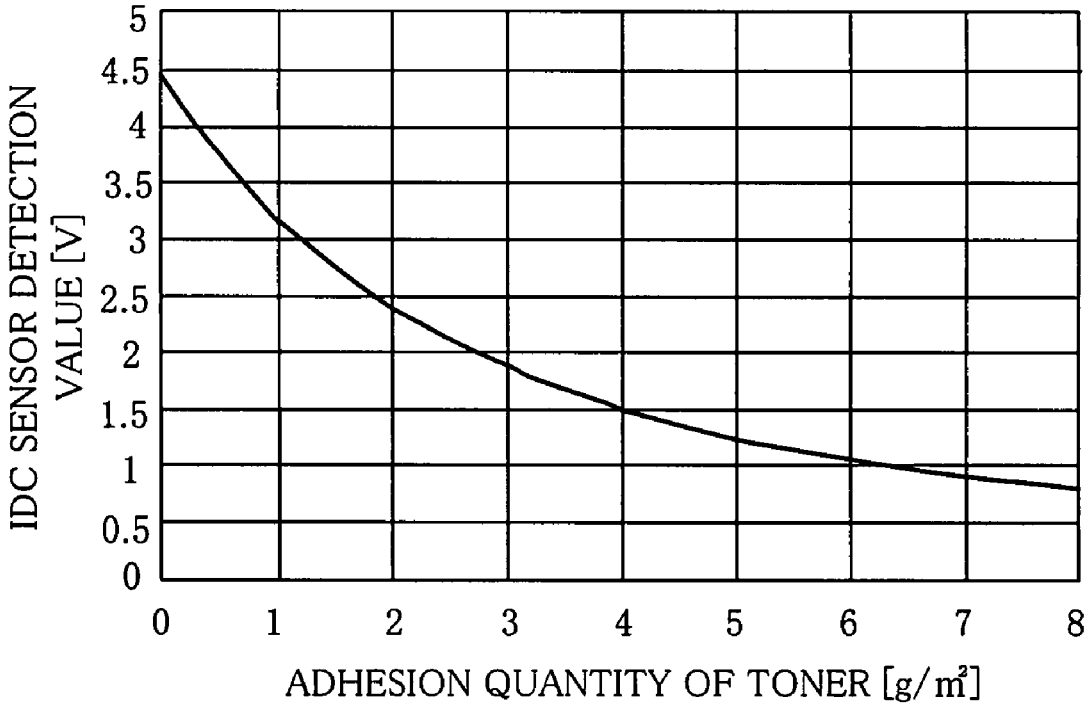
FIG. 9 is a diagram showing characteristics of toner quantity detected by an IDC sensor.
Figure 10:
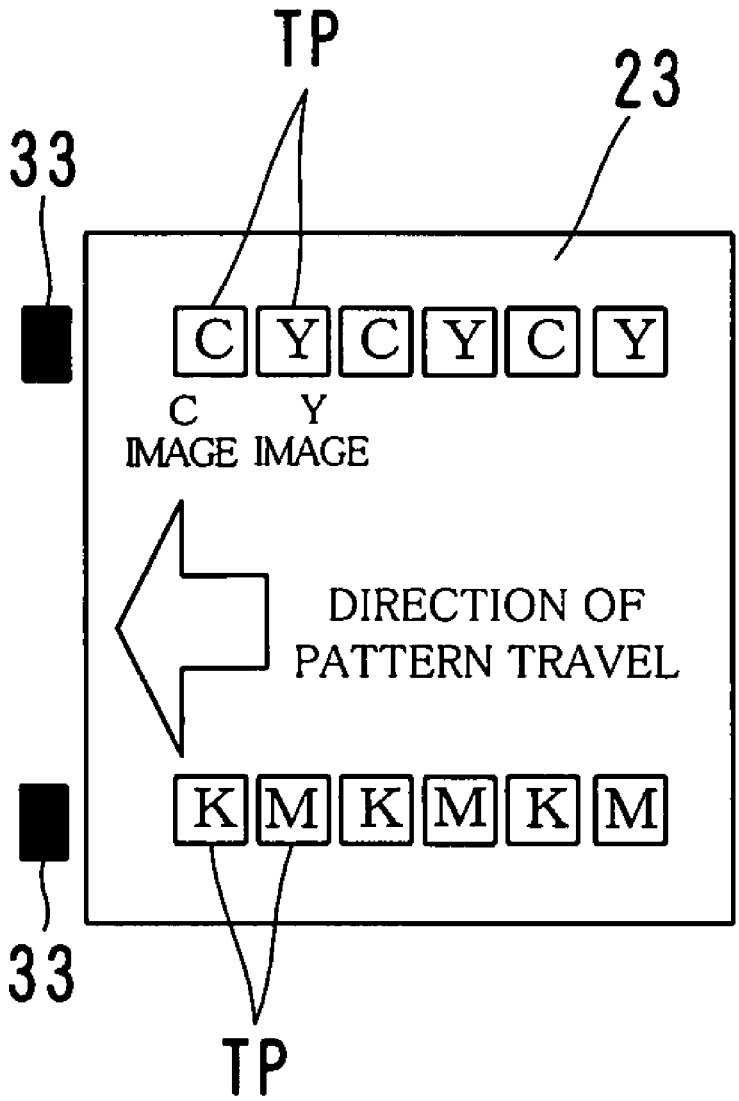
FIG. 10 is a diagram showing an example of a toner patch.

FIG. 9 is a diagram showing characteristics of toner quantity detected by the IDC sensor 33, and FIG. 10 is a diagram showing an example of a toner patch.

As shown in FIG. 10, the toner patches TP are formed on positions near to both sides of the surface of the intermediate transfer belt 23, and they move as the intermediate transfer belt 23 runs. They are detected by the two IDC sensors 33. The IDC sensor 33 outputs a voltage that corresponds to density of the toner patch TP. This voltage output (IDC sensor detection value) is converted into adhesion quantity of toner by using characteristics shown in FIG. 9. In accordance with the converted value of adhesion quantity, the development bias voltage corresponding to aimed adhesion quantity is determined.

In this way, the toner patches TP are formed on the surface of the intermediate transfer belt 23 when the image adjustment is performed. Therefore, if the secondary transfer roller 28 is pressed to the intermediate transfer belt 23, the secondary transfer roller 28 may become dirty with toner. In addition, the rear side of a paper sheet PA may become dirty with toner during the normal printing. In order to avoid these problems, it is necessary to set the secondary transfer roller 28 in the separated state when the image adjustment is performed.

Therefore, when the image adjustment is performed, the separation instruction S2 is issued, and the press and separation driving device SK works so that the secondary transfer roller 28 becomes the separated state. After the press and separation detecting device ST detects the separated state, a sequence of the image adjustment is performed.

Next, an example of a control and an operation of the press and separation detecting device ST will be described with reference to a flowchart.

Figure 11:
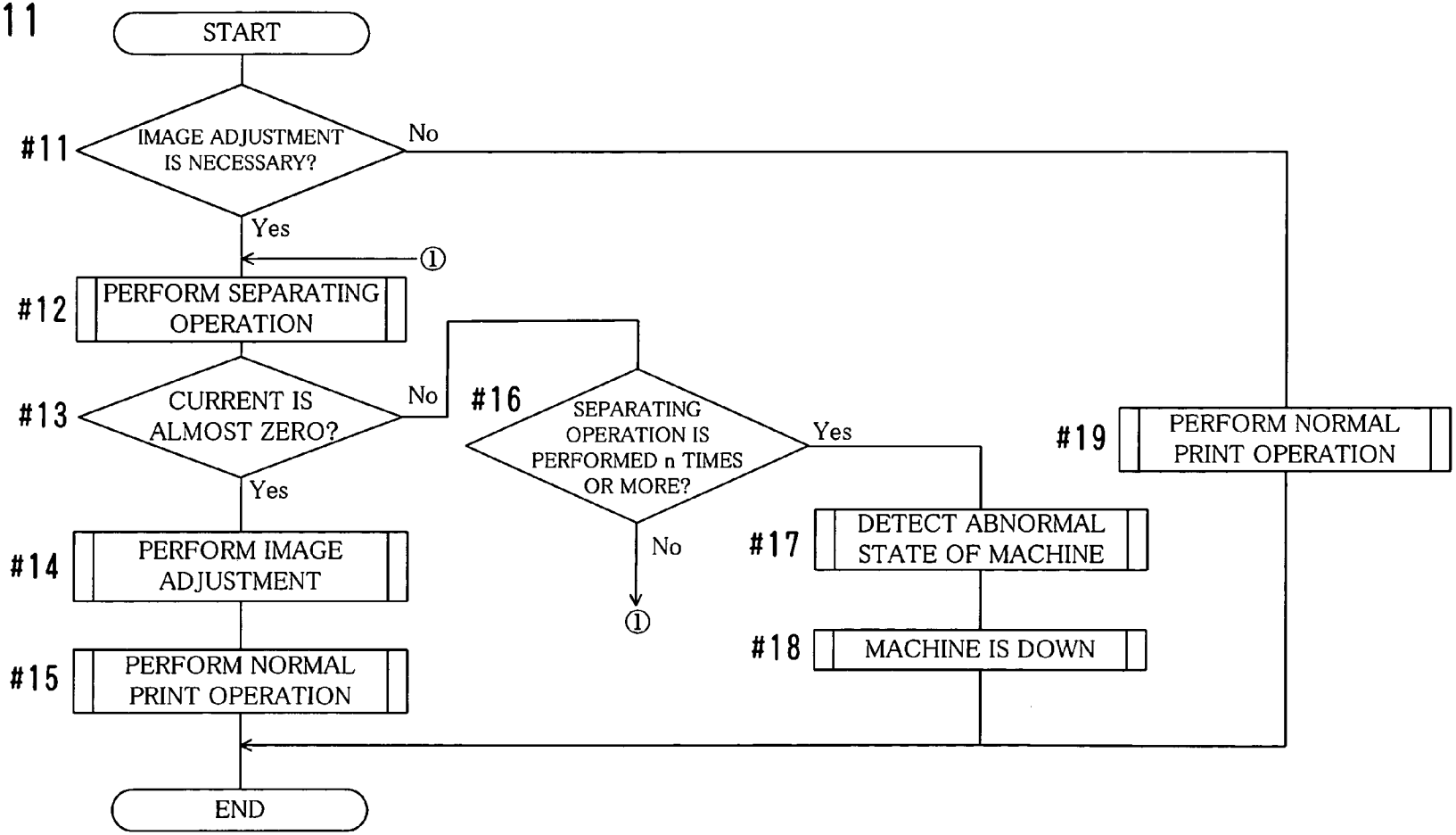
FIG. 11 is a flowchart showing an example of a general control operation of the press and separation detecting device.

FIG. 11 is a flowchart showing an example of a general control operation of the press and separation detecting device ST.

In FIG. 11, usually before starting a print operation, it is determined whether or not the image adjustment is necessary (#11). If it is determined that the image adjustment is necessary, the separation instruction S2 is issued, and the separating operation is performed (#12). The current I that flows into the intermediate transfer belt 23 is detected, and it is determined whether or not the current I is almost zero (#13).

If the result is "YES" in the step #13, it is confirmed that the secondary transfer roller 28 has become the separated state, so the image adjustment is performed (#14). After that, a normal print operation is performed (#15). In the first stage of the print operation in the step #15, the secondary transfer roller 28 is returned to the pressed state in accordance with the press instruction S1.

If the result in the step #11 is "NO", the image adjustment is not performed, and the normal print operation is performed in the pressed state (#19).

If the result in the step #13 is "NO", the separating operation is performed again in the step #12 until the separating operation is performed a predetermined number of times, e.g., three times (#16). This is because there may be the case where the cam 55 of the press and separation detecting device ST cannot slide easily, for example. If the current I does not become almost zero even though the separating operation was performed a predetermined number of times, it is determined that the press and separation driving device SK is in an abnormal state, and the operation of the image forming apparatus 1 is stopped.

It is possible to perform the normal print operation in the pressed state of the secondary transfer roller 28 even if the separated state is not detected in the step #13. However, it is not preferable to perform the print operation in the state where the image adjustment is not performed, since it is a waste print. In addition, trying to perform the image adjustment in the pressed state is not preferable too because the dirty state as described above may happen. Therefore, it is preferable to stop the operation of the image forming apparatus in this case.

Next, the press and separation detecting device ST3 according to a second embodiment of the present invention will be described.

In the second embodiment, a voltage is applied to the secondary transfer roller 28 under a condition of constant current, and the applied voltage is detected. When the detected voltage becomes larger than a predetermined value, it is determined to be in the separated state.

Figure 12:
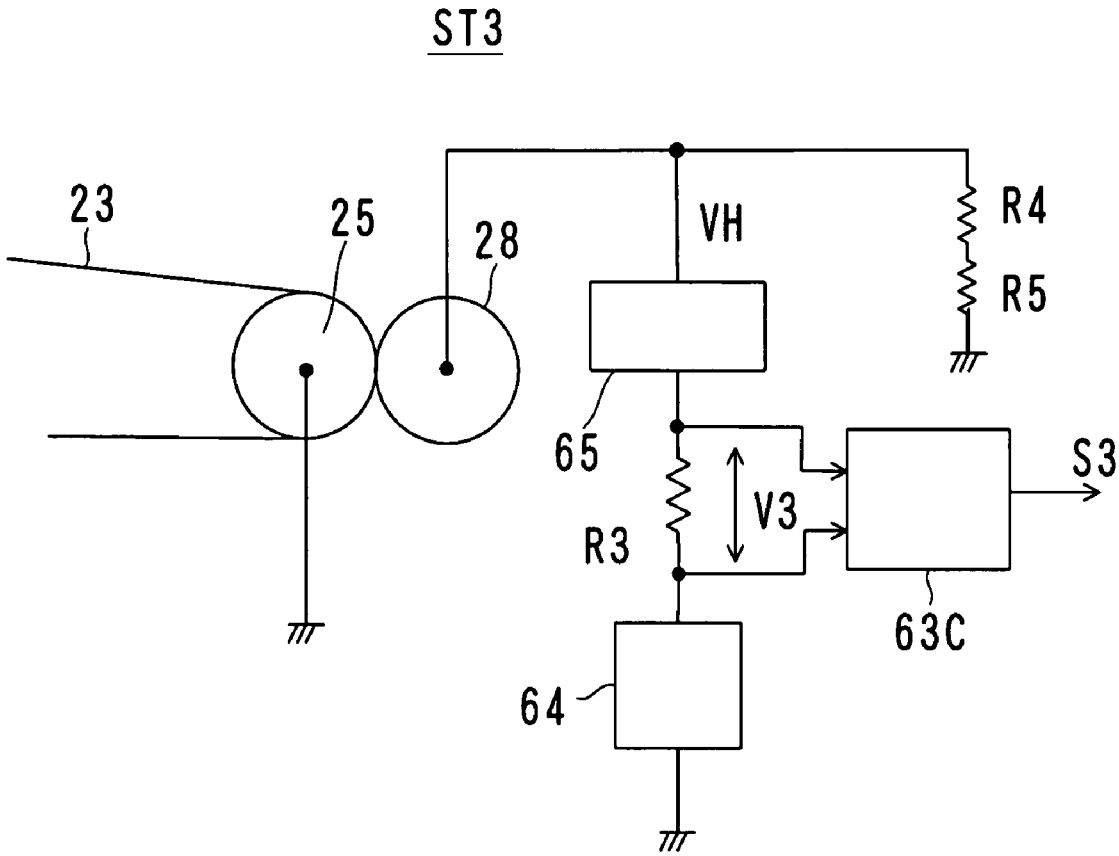
FIG. 12 is a diagram showing a circuit of a press and separation detecting device according to a second embodiment of the present invention.

FIG. 12 is a diagram showing a circuit of a press and separation detecting device ST3 according to the second embodiment of the present invention. Note that elements that have functions similar to those in the press and separation detecting device ST1 of the first embodiment are denoted by the same reference signs.

As shown in FIG. 12, a high voltage generator 65 applies a high voltage VH to the secondary transfer roller 28. The high voltage generator 65 includes a high voltage transformer that generates a high voltage VH that corresponds to input current I3. For example, the input current I3 of the high voltage generator 65 is 10 microamperes, a voltage VH of 5 KV is output. The voltage VH that is applied to the secondary transfer roller 28 is detected by detecting the input current I3. The current I3 is detected as a voltage V3 across a resistor R3. More specifically, the voltage V3 corresponding to the current I3 is detected by using the resistor R3, and the detection result is given to a determination portion 63C.

If the secondary transfer roller 28 is in the separated state, a high voltage VH shows up to the output terminal of the high voltage generator 65, and the voltage VH is lowered if the secondary transfer roller 28 is in the pressed state. Therefore, it is detected to be in the separated state when the detected voltage V3 becomes larger than the threshold value Th, for example. In this way, the voltage VH is detected by detecting the input current I3, thereby the pressed or separated state of the secondary transfer roller 28 is detected. Note that the input current I3 to the high voltage generator 65 is supplied from a power supply for transformer 64.

For example, the pressing operation is performed while the current I3 of 10 microamperes flows from the power supply for transformer 64. If the secondary transfer roller 28 is separated from the intermediate transfer belt 23 by a sufficient distance, the voltage VH that is applied to the secondary transfer roller 28 becomes the maximum output value of 5 KV. Therefore, when the output value becomes 5 KV or higher, it is determined that the separating operation is completed. If the output value is lower than 4 KV for example, the separating operation is performed again as the separating operation is not completed. In this case, if the output value is still lower than 4 KV when a predetermined time period has passed after the secondary transfer roller 28 is driven to become the separated state, it may be decided that the separating operation is not completed. The length of the predetermined time period can be set variously.

In addition, it is possible to output a signal indicating an abnormal state if the separated state is not detected even after driving the secondary transfer roller 28 to become the separated state a predetermined number of times.

Note that an appropriate voltage detection portion may be used for detecting the voltage VH output by the high voltage generator 65. More specifically, the current I3 that is supplied to the high voltage generator 65 is kept in a preset constant value, while the voltage VH that changes in accordance with the pressed or separated state of the secondary transfer roller 28 is detected, for example. If the secondary transfer roller 28 is in the separated state, the voltage VH becomes the maximum value. If it is in the pressed state, the voltage VH becomes lower than the maximum value. This change of the voltage VH is detected by a voltage detection portion, and the determination portion 63C determines the pressed or separated state.

According to the first and the second embodiments described above, the pressed or separated state of the secondary transfer roller 28 can be detected at a low cost without a special detection device such as a photointerrupter.

In the embodiments described above, the connection positions and resistance values of the resistors R1-R3 can be variously modified from the examples described above. Although the examples described above use the intermediate transfer belt 23 as the intermediate transfer member, other image carrier such as an intermediate transfer roller may be used instead of the intermediate transfer belt 23. In addition, the structure of the voltage applying portion 61, the determination portions 63, 63B and 63C, the power supply for transformer 64 or the high voltage generator 65 can be modified variously from the examples described above. It is just important to detect the current I that flows in the opposed portion due to a change of the pressed state or the separated state of the transfer member.

Furthermore, the structure, the configuration, the circuit, the shape, the dimensions, the number, the material, the process contents, the process order or the like of a whole or a part of the press and separation driving device SK, the press and separation detecting device ST or the image forming apparatus 1 can be modified if necessary in accordance with the spirit of the present invention.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. An image forming apparatus having a structure in which a toner image formed in an electrophotographic process is transferred from an image carrier to a member to be transferred, the apparatus comprising:

a transfer member that becomes a pressed state with respect to the image carrier to make the same perform a transfer process and can move between the pressed state and a separated state;

a press and separation driving device for driving the transfer member to become the pressed state and the separated state;

a press and separation detecting device for detecting the pressed state and the separated state of the transfer member; and a voltage applying portion for applying a voltage between the image carrier and the transfer member, wherein the press and separation detecting device includes a current detecting portion for detecting a current that flows between the image carrier and the transfer member when the voltage is applied by the voltage applying portion, and a determination portion for determining the pressed state and the separated state of the transfer member in accordance with the current detected by the current detecting portion, wherein the determination portion determines the separated state when a gradient of decrease in the value of the current during a predetermined time period is larger than a predetermined value.

2. The image forming apparatus according to claim 1, wherein the press and separation driving device drives the transfer member again to become the separated state if the press and separation detecting device does not detect the separated state after the press and separation driving device drove the transfer member to become the separated state.

3. The image forming apparatus according to claim 1, wherein a signal indicating an abnormal state is output if the press and separation detecting device does not detect the separated state after the press and separation driving device drove the transfer member to become the separated state.

4. The image forming apparatus according to claim 1, wherein a control of a NIP width of the image carrier and the transfer member is performed in accordance with a value of the current detected by the current detecting portion.

5. A method for detecting a separated state of a transfer member that becomes a pressed state with respect to an image carrier and a voltage is applied between the transfer member and the image carrier for performing a transfer process in an image forming apparatus having a structure in which a toner image formed in an electrophotographic process is transferred from the image carrier to the member to be transferred, the method comprising the steps of:

detecting a current that flows between the image carrier and the transfer member when the voltage is applied; and detecting the separated state when a gradient of decrease in a value of the current becomes larger than a predetermined value.

* * * * *